US008171853B2

(12) United States Patent
Purvis

(10) Patent No.: US 8,171,853 B2
(45) Date of Patent: May 8, 2012

(54) PROJECTILE FOR DELIVERING AN INCAPACITATING AGENT

(75) Inventor: John W. Purvis, Littleton, CO (US)

(73) Assignee: Sierra Nevada Corporation, Sparks, NV (US)

( * ) Notice: Subject to any disclaimer, the term of this patent is extended or adjusted under 35 U.S.C. 154(b) by 248 days.

(21) Appl. No.: 12/716,160

(22) Filed: Mar. 2, 2010

(65) Prior Publication Data

US 2011/0214584 A1 Sep. 8, 2011

(51) Int. Cl.
*F42B 12/46* (2006.01)

(52) U.S. Cl. ..... 102/512; 102/501; 102/502

(58) Field of Classification Search ..... 102/364–367, 102/370, 440, 501, 502, 512, 513
See application file for complete search history.

(56) References Cited

U.S. PATENT DOCUMENTS

| | | | | | |
|---|---|---|---|---|---|
| 1,417,475 | A | * | 5/1922 | Weeke | 102/370 |
| 1,671,364 | A | * | 5/1928 | Gangnes | 102/370 |
| 2,096,698 | A | * | 10/1937 | Lowy et al. | 102/370 |
| 2,247,111 | A | * | 6/1941 | Batchelor et al. | 102/501 |
| 3,289,588 | A | * | 12/1966 | Hitchens et al. | 102/513 |
| 3,289,589 | A | * | 12/1966 | Hitchens et al. | 102/513 |
| 3,374,740 | A | * | 3/1968 | Voda | 102/370 |
| 3,820,465 | A | * | 6/1974 | Delphia | 102/512 |
| 3,983,817 | A | | 10/1976 | Tucker | |
| 4,063,512 | A | * | 12/1977 | Davis | 102/476 |
| 4,627,354 | A | * | 12/1986 | Diamond et al. | 102/368 |
| 4,667,601 | A | * | 5/1987 | Diamond et al. | 102/368 |
| 4,798,143 | A | * | 1/1989 | Graham | 102/370 |
| 5,078,117 | A | | 1/1992 | Cover | |
| 5,086,703 | A | * | 2/1992 | Klein | 102/439 |
| 5,221,809 | A | * | 6/1993 | Cuadros | 102/439 |
| 5,230,531 | A | | 7/1993 | Hamilton et al. | |
| 5,299,501 | A | * | 4/1994 | Anderson | 102/364 |

(Continued)

FOREIGN PATENT DOCUMENTS

WO WO 9749968 A1 * 12/1997

(Continued)

OTHER PUBLICATIONS

International Search Report on corresponding PCT application (PCT/US2011/026742) from International Searching Authority (KIPO) dated Nov. 25, 2011.

(Continued)

*Primary Examiner* — Michael Carone
*Assistant Examiner* — Joshua Freeman
(74) *Attorney, Agent, or Firm* — Klein, O'Neill & Singh, LLP

(57) ABSTRACT

A projectile for delivering an incapacitating agent through a barrier includes a canister containing the agent and having a closure. The canister is retained in a holder to which is fixed a sleeve formed of a plurality of axial fingers configured to spread radially outward upon impact with the barrier. A ballistic body, configured to penetrate the barrier and having a dispersion port, is connected to the holder forward of the canister so as to be axially movable from a forward position to a rearward position upon impact with the barrier, the ballistic body including a closure-breaching member located so as to breach the closure as the ballistic body moves rearward, thereby placing the canister in fluid communication with the dispersion port. The fingers spread radially against the surface of the barrier opposite the dispersion port so as to lodge the projectile in the barrier.

24 Claims, 5 Drawing Sheets

U.S. PATENT DOCUMENTS

| | | | | |
|---|---|---|---|---|
| 5,361,701 | A | 11/1994 | Stevens | |
| 6,209,461 | B1 * | 4/2001 | Riffet et al. | 102/513 |
| 6,250,226 | B1 * | 6/2001 | Leichter et al. | 102/370 |
| 6,523,478 | B1 * | 2/2003 | Gonzalez et al. | 102/485 |
| 7,278,358 | B2 * | 10/2007 | Huffman | 102/502 |
| 7,549,376 | B1 * | 6/2009 | Grossman et al. | 102/473 |
| 7,621,220 | B1 * | 11/2009 | Sanford et al. | 102/370 |
| 2003/0140813 | A1 * | 7/2003 | Rosenkranz et al. | 102/473 |
| 2005/0116090 | A1 * | 6/2005 | Welty et al. | 244/13 |
| 2011/0079164 | A1 * | 4/2011 | Broden et al. | 102/444 |

FOREIGN PATENT DOCUMENTS

| | | | |
|---|---|---|---|
| WO | WO 9749969 | A1 * | 12/1997 |
| WO | WO 9846964 | A1 * | 10/1998 |
| WO | WO 2005078379 | A1 * | 8/2005 |

OTHER PUBLICATIONS

Written Opinion on corresponding PCT application (PCT/US2011/026742) from International Searching Authority (KIPO) dated Nov. 25, 2011.

* cited by examiner

PROJECTILE FOR DELIVERING AN INCAPACITATING AGENT

CROSS-REFERENCE TO RELATED APPLICATIONS

Not Applicable

FEDERALLY FUNDED RESEARCH OR DEVELOPMENT

Not Applicable

BACKGROUND

This disclosure relates generally to the field of munitions. More specifically, it relates to munitions or projectiles launched or fired from single person-operated, particularly shoulder-fired, weapons. Still more specifically, it relates to a round or projectile that is launched or fired from a grenade launcher or the like, and that is configured to deliver an incapacitating agent to a target through a solid barrier.

There are many tactical situations, in both military and law enforcement contexts, in which it is necessary or desirable to incapacitate an adversarial human target short of lethality. Typically, the incapacitating agent is a non-lethal aerosol or gas, such as tear gas or one if its variants, such as CS. The typical method of delivering the agent is to throw or launch a gas-dispersing canister or grenade at the target. This method works reasonably well when the target is confronted without an intervening barrier, or when the target is in a room having an outside window that can be penetrated easily by the canister or grenade.

A problem exists, however, when the target is in a structure, vehicle, or other enclosure that is not accessible through an easily-penetrated barrier, such as a glass window, or when the target is in a structure is beyond the range of the conventional gas-dispersing canister or grenade. In such situations, law enforcement or military personnel must place themselves at increased risk in order to position themselves to allow the effective deployment of the incapacitating agent. Furthermore, the canister or grenade usually lands on the floor of the structure, vehicle, or enclosure, thereby possibly affording the target an opportunity to dispose of the canister or grenade before being incapacitated.

Thus, there is a heretofore unmet need for a device, mechanism, and/or method for delivering an incapacitating agent to a target in a structure or enclosure that cannot be reached or penetrated by conventional gas-dispersing munitions. Furthermore, it would be advantageous to provide such a projectile that begins dispersing the agent almost immediately upon impact and that is not easily disposed of by the target. Finally, it would be advantageous to combine these features in a projectile that can be fired from a conventional grenade launcher.

SUMMARY

Broadly, in accordance with a first aspect, the subject of the present disclosure is a projectile configured for delivering an incapacitating agent to a target through a solid barrier, the projectile comprising a canister configured to contain an incapacitating agent and having an outlet with a breachable closure; a canister holder configured to hold the canister and having an external surface; a deformable, radially-expansible sleeve fixed to the external surface of the canister holder and configured to spread radially outward upon impact with the solid barrier; a ballistic body movably connected to the canister holder forward of the canister so as to be axially movable from a forward position to a rearward position upon impact with the barrier, the ballistic body including a closure-breaching member located so as to breach the closure when the ballistic body moves axially rearward upon impact with the barrier, the ballistic body further including a plurality of dispersion ports that are in fluid communication with the outlet of the canister when the closure is breached.

In accordance with a more specific aspect, the subject of the present disclosure is a projectile configured for delivering an incapacitating agent to a target through a solid barrier, the projectile comprising a canister filled with an incapacitating agent and having an outlet with a breachable closure; a canister holder having an external surface; a substantially cylindrical deceleration sleeve that is fixed to the external surface of the canister holder and that is divided around its circumference into a plurality of radially-deformable axial fingers configured to spread radially outward upon impact with a solid barrier; and a ballistic body movably connected to the canister holder forward of the canister so as to be axially movable from a forward position to a rearward position upon impact with the bather, the ballistic body including a conical portion terminating in a penetration tip at its forward end, and a closure-breaching member located so as to breach the closure when the ballistic body is moved to its rearward position, thereby opening a fluid path from the canister through the ballistic body; whereby the penetration tip is configured to penetrate the barrier upon impact therewith, and wherein the movement of the ballistic body to its rearward position forces the axial fingers to spread radially outward against the barrier upon impact therewith, thereby lodging the ballistic body in the barrier in position for the dispersal of the incapacitating agent on the side of the barrier opposite the fingers.

In a preferred embodiment, the gas-dispersing projectile of the present disclosure is configured and adapted to be fired from a conventional grenade launcher. To this end, the deceleration sleeve and the canister holder are advantageously enclosed coaxially in a frangible cylindrical outer sleeve that is dimensioned to fit any of several standard grenade launcher bore sizes. The outer sleeve may advantageously be provided with one or more circumferential ridges or beads that engage the rifling of the grenade launcher barrel, so as to impart a stabilizing gyroscopic spin to the projectile for enhanced accuracy. In a preferred embodiment, a frangible nose cone, enclosing the penetration tip of the ballistic body, is fixed to the forward end of the outer sleeve. The nose cone engages against the forward ends of the axial fingers, so that, on impact with a solid barrier, the nose cone applies a radially-outward force against fingers to initiate their radial spread. Rearward of the outer sleeve, a shell casing coaxially encloses and engages the rearward portion of the canister holder. The shell casing is filled with a propellant powder charge and is provided with a center-fire primer cap.

The projectile of the present disclosure offers significant advantages over conventional gas-dispersing projectiles or munitions. For example, after being launched from a conventional grenade launcher, the projectile strikes a barrier surface (e.g., a wall or roof) near the human target. The penetration tip penetrates the barrier, and as it does so, the segments or fingers of the deceleration sleeve peel back axially and spread radially outward, thereby lodging against the barrier surface and thus preventing the projectile body from completely passing through the barrier. Furthermore, upon striking the barrier surface, the ballistic body is pushed axially to its rearward position, whereby the closure-breaching member breaches the closure of the container or capsule containing the incapacitating agent, thereby providing a flow path for the agent from the container or capsule out through the dispersion ports into the room or enclosure in which the human target is located. Thus, by dispersing the agent upon impact with the barrier, while being, in effect "stuck" in the barrier (perhaps out of reach of the target), the projectile is capable, in many instances, of delivering an incapacitating "dose" of the agent before the target can remove either the projectile or himself from the premises. These and other advantages will be more clearly understood from the detailed description that follows:

DETAILED DECRIPTION

Figure 1:
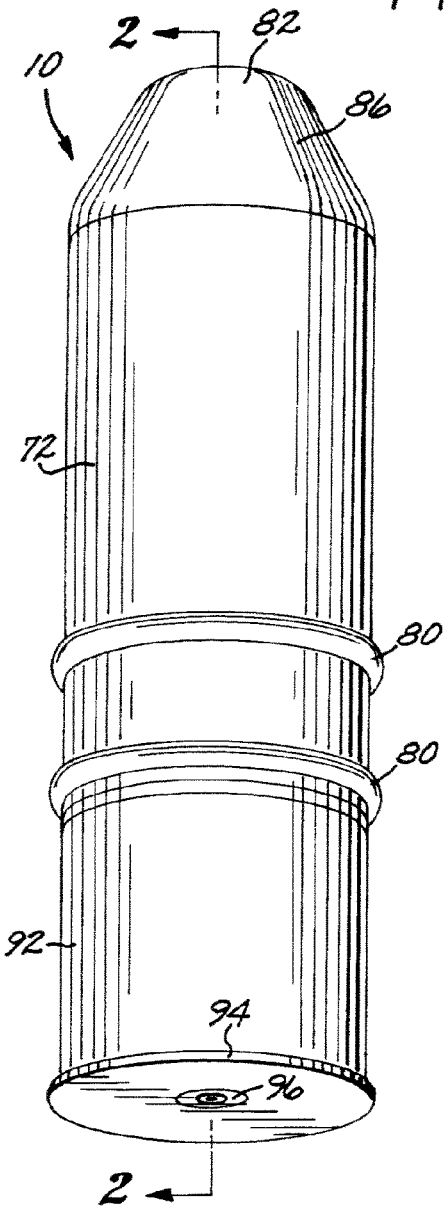
FIG. 1 is a perspective view of a gas-dispersing projectile in accordance with a specific embodiment of the present disclosure.

Referring first to FIGS. 1-8, a gas-dispersing projectile 10, in accordance with a preferred embodiment of this disclosure, includes a fluid canister 12 mounted in a substantially tubular canister retention assembly, comprising a canister holder 14 and a canister retention collar 16, both of which may advantageously made of a strong, light-weight metal, such as aluminum. A substantially tubular, radially-expansible deceleration sleeve 18 is attached to the exterior of the canister holder 14, as will be described in more detail below. A gas-dispersing ballistic body 20 is movably connected to the canister holder 14, forward of the canister 12, as will be described below. The canister 12 is suitable for filling with a fluid (liquid or gas) 21 which, in most applications, will be a non-lethal incapacitating agent, such as, for example, tear gas or a variant (e.g., CS) in liquid form. In other applications, the fluid 21 may be a tracking agent (a dye, for example), or a foul-smelling repellant. The canister 12 has a neck 22 that extends forward into an open-ended central chamber 24 at the rearward end of the ballistic body 20. The canister neck 22 terminates in a penetrable or frangible closure or seal 26 that closes an opening 28 at the end of the neck 22 that is situated within the chamber 24.

The canister holder 14 has an interior that is configured and dimensioned for snugly receiving the canister 12. The canister holder 14 includes a forward portion 30, an intermediate portion 32, and a rear portion 34. The deceleration sleeve 18 has a rearward end that is fixed to the intermediate portion 32 of the canister holder 14, as will be more fully described below. A base 36, preferably of aluminum, is fixed to, or, alternatively, integral with, the rear portion 34 of the canister holder 14, and it has an interior surface against which the canister 12 seats. The forward portion 30 of the canister holder is internally threaded. The canister retention collar 16 is dimensioned to fit snugly around the forward portion of the canister 12, and it has an externally-threaded rearward portion 38 that is threaded into the forward portion 30 of the canister holder 14 to form with the canister holder 14 the aforementioned canister retention assembly. An O-ring 40, seated between the canister 12 and the interior surface of the retention collar 16, may advantageously be included as part of the canister retention assembly to provide a compressible engagement between the canister 12 and the retention collar 16, thereby enhancing the security of the canister retention function of the canister retention assembly. The externally threaded portion 38 of the retention collar 16 has an internal diameter that is approximately the same as that of the canister holder 14, so that the externally threaded portion 38 of the retention collar 16 and the canister holder 14 form a continuous interior surface that is dimensioned to hold the canister 12.

Figure 11:
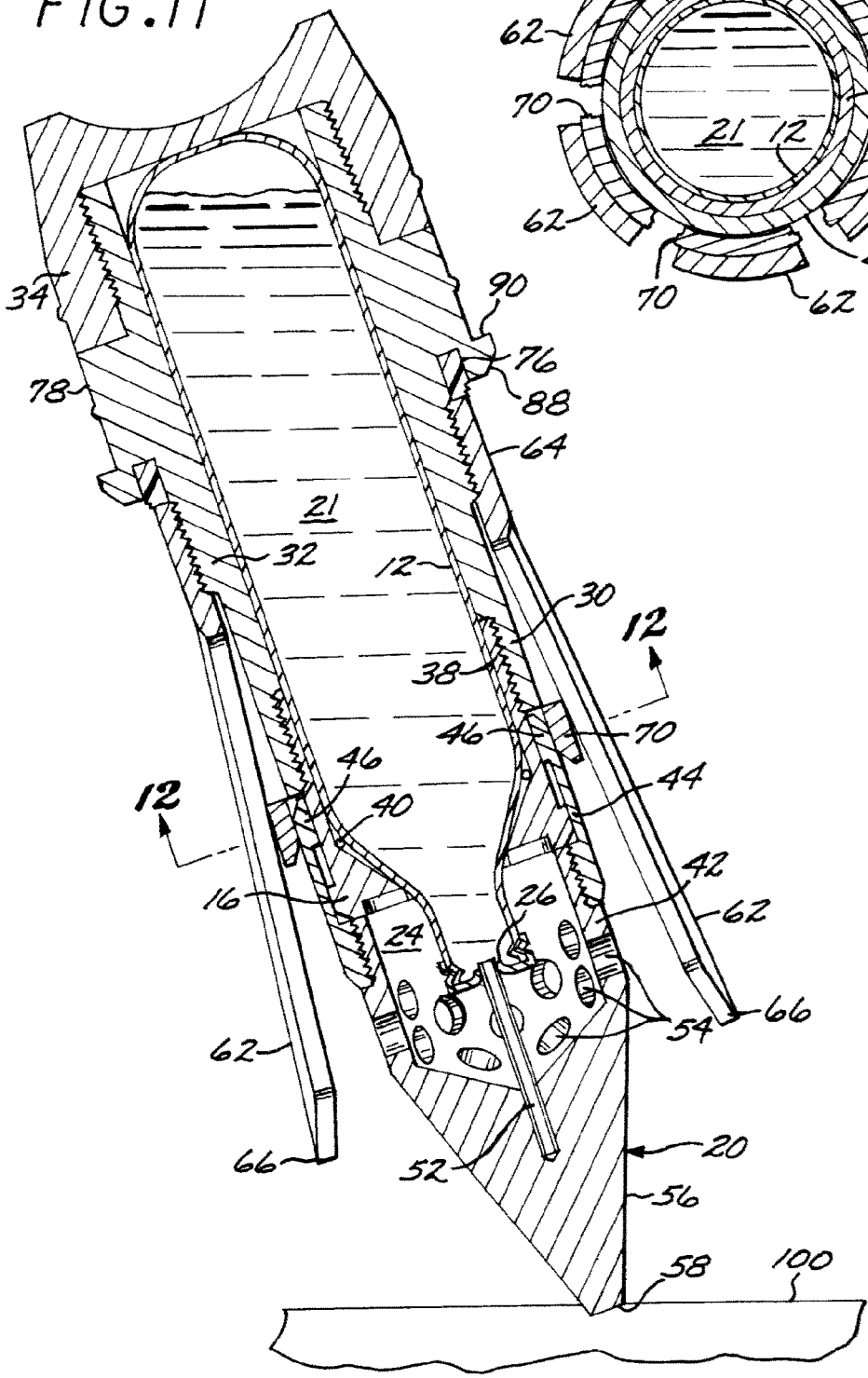
FIG. 11 is a cross-sectional view similar to that of FIG. 9, but showing the penetration tip entering the solid barrier and the continuation of the radial spreading of the deceleration sleeve.

The ballistic body 20 has an annular rear portion 42 defining the above-mentioned open-ended chamber 24. The annular rear portion 42 of the ballistic body 20 is externally threaded for attachment to an internally threaded forward portion of an annular linkage element 44, the rear portion of which has a reduced inside diameter and is configured as an annular cam element 46 (to be described more fully below) that normally seats in the forward portion of an annular recess 48 in the exterior surface of the retention collar 16. The annular recess 48 is substantially larger in the axial direction than the axial dimension of the cam element 46, so as to provide a track in which the cam element 46 can move axially in the recess 48, in a rearward direction, thereby allowing, as will be seen, the linkage element 44 (and thus also the ballistic body 20 attached to it) to move axially with respect to the canister 12 from a forward position (FIGS. 2 and 9) to a rearward position (FIG. 11). In its forward position, the linkage element 44, which may advantageously be made of aluminum, separates the ballistic body 20 from the canister retention collar 16 by a space 50, with the neck 22 of the canister 12 extending into the chamber 24, as mentioned above.

Fixed in the ballistic body 20 so as to extend rearward into the chamber 24 is a closure-breaching member 52, preferably formed as a metal rod or pin. The closure-breaching member 52 has a length dimensioned so that it terminates a short distance from the closure or seal 26. As will be seen, axial movement of the ballistic body 20 in the rearward direction (i.e., toward the canister retention assembly 14, 16) in response to the projectile striking a barrier causes the closure-breaching member 52 to puncture or rupture the seal or closure 26 to release the contents of the canister 12, which then flows into the chamber 24 and out of the ballistic body 20 through at least one dispersion port 54, and preferably a plurality of dispersion ports 54, extending radially from the chamber 24 to the exterior of the ballistic body 20.

The ballistic body 20 has a substantially conical forward end portion 56 that tapers to a penetration tip 58 at the extreme forward end. Other configurations for the forward end portion 56 may suggest themselves as advantageous for particular applications. The material of the ballistic body 20, and particularly the forward end portion 56, may be selected for particular applications. For example, stainless steel (e.g., 300 series stainless steel) may be suitable for penetrating build walls, while depleted uranium may be used for armor-piercing applications.

Figure 5:
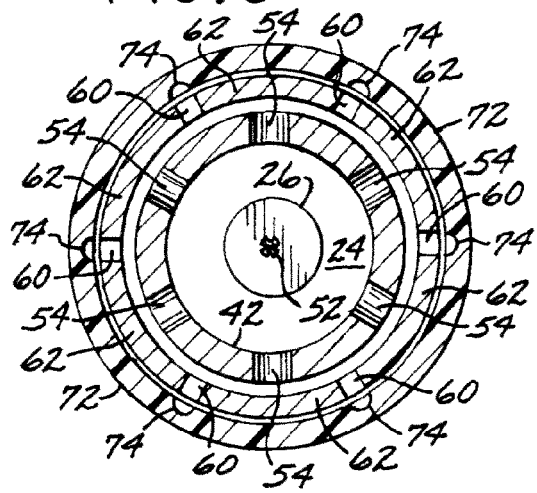
FIG. 5 is a cross-sectional view taken along line 5-5 of FIG. 2.
Figure 4:
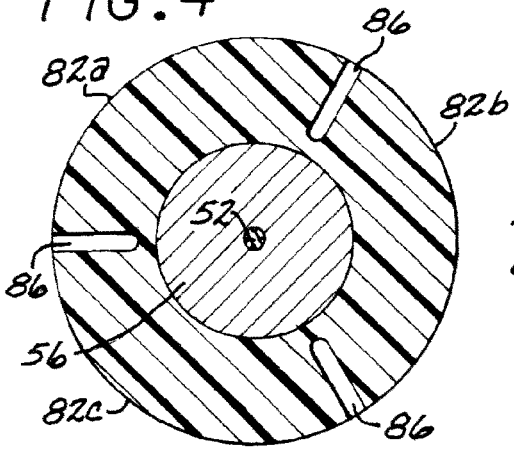
FIG. 4 is a cross-sectional view taken along line 4-4 of FIG. 2.
Figure 6:
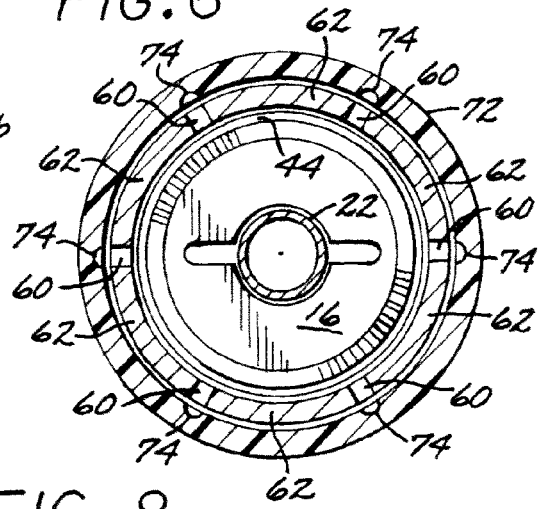
FIG. 6 is a cross-sectional view taken along line 6-6 of FIG. 2.
Figure 7:
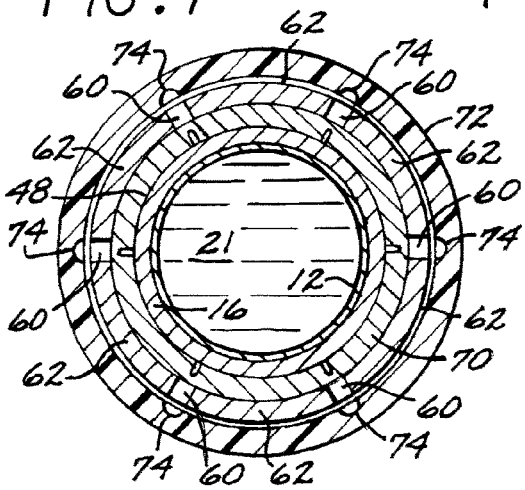
FIG. 7 is a cross-sectional view taken along line 7-7 of FIG. 2.
Figure 8:
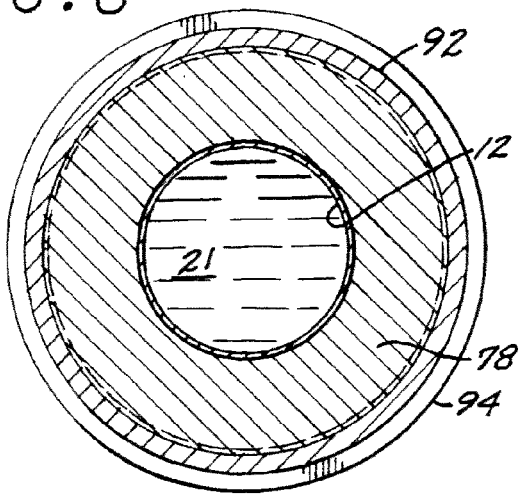
FIG. 8 is a cross-sectional view taken along line 8-8 of FIG. 2.

As best shown in FIGS. 5, 6, and 7, the deceleration sleeve 18, which may advantageously be made of mild steel, is advantageously divided by a plurality of axial slits 60 into a plurality of circumferentially-adjoining deformable axial sleeve segments, each of which defines an axially-extending deformable finger 62. In the illustrated embodiment, each of the fingers 62 extends forward from an annular attachment fitting 64 to a tip portion 66 that is advantageously pointed. The attachment fitting 64 is attached to the external surface of the intermediate portion 30 of the canister holder 14. In one embodiment, as illustrated, the attachment fitting 64 may be internally threaded to mate with external threads on the intermediate portion 30 of the canister holder 14. Alternatively, the attachment fitting 64 may be formed integrally with the canister holder 14. The tip portion 66 of each finger 62 preferably extends a short distance forward of the rearward end of the conical portion 56 of the ballistic body 20.

Figure 2:
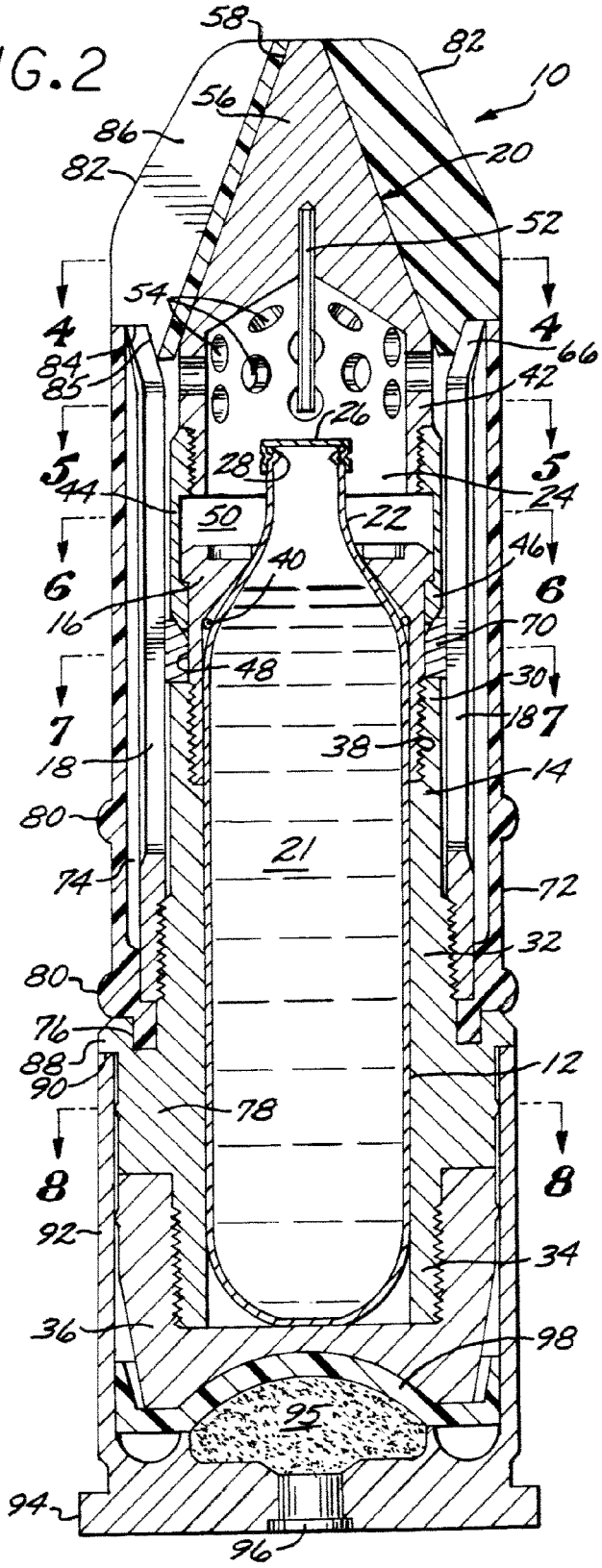
FIG. 2 is a cross-sectional view taken along line 2-2 of FIG. 1.
Figure 3:
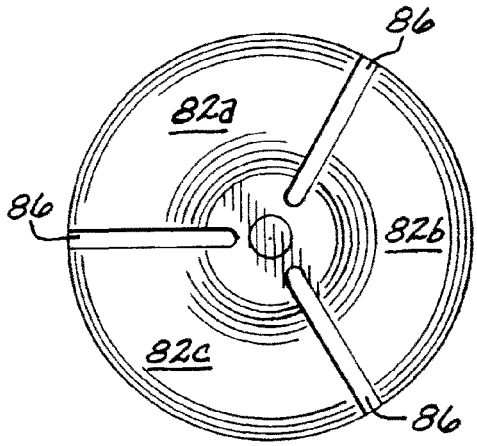
FIG. 3 is a top plan view of the projectile of FIG. 1.

As best seen in FIGS. 2 and 7, each of the fingers 62 has a cam follower element 70 on its interior surface. The cam follower elements 70 seat in the rear portion of the annular recess 48 of the canister holder 14. Each of the cam follower elements 70 has a sloped forward face that engages with, and is complementary, to a sloped rearward face on the cam element 46 of the linkage element 44. In the exemplary embodiment illustrated, there are six deceleration sleeve segments or fingers 62 (see, e.g., FIGS. 10, 12, and 14), but the number may vary from as few as three or four, to as many as eight or more.

To assure a proper fit in the bore of a typical grenade launcher, a frangible, substantially cylindrical outer sleeve 72 is provided coaxially around the exterior of the deceleration sleeve 18. For example, the outer sleeve 72 may have an outside diameter of 37 mm or 40 mm, thereby conforming to typical grenade launcher bores. The outer sleeve 72, which may be made of laser-sintered nylon, is advantageously provided with a plurality of equidistantly-spaced, axially-extending grooves 74 (see FIG. 5) that form partition lines to facilitate the fragmentation and separation of the outer sleeve 72, as will be explained below. The forward end of the outer sleeve 72 is, advantageously, approximately coextensive with the tips of the fingers 62, while the rearward end of the outer sleeve 72 is retained in a forward-facing annular slot 76 provided in an increased-diameter section 78 of the canister holder 14, located just rearward of the juncture between the attachment fitting 64 of the deceleration sleeve 18 and the intermediate portion 30 of the canister holder 14. The outer sleeve 72 may advantageously be provided with one or more circumferential ridges or beads 80 on its outer surface. The beads 80, if present, are configured to engage rifling in a grenade launcher bore, so that a gyroscopic spin is imparted to the projectile when it is launched, thereby enhancing its accuracy.

In a preferred embodiment, a frangible nose cone 82, enclosing the conical portion 56 of the ballistic body 20, may advantageously be fixed to the forward end of the outer sleeve 72. The nose cone 82, which advantageously has an aerodynamically-shaped outer surface, has a rearward-facing annular shoulder 84 that seats both the forward end of the outer sleeve 72 and the forward tip portions 66 of the axial fingers 62. The shoulder 84 defines an angled camming surface 85 that engages against the interior surface of the forward tip portions 66 of the axial fingers 62. Thus, as will be explained below, on impact with a solid barrier, the camming surface 85 of the nose cone 82 applies a radially-outward force against the fingers 62 to initiate their radial spread, which, in turn, causes the outer sleeve 72 to fragment. The nose cone 82, if present, is preferably made of the same frangible material as the outer sleeve 72 (e.g., laser-sintered nylon). It is also preferably divided by a plurality of slits 86, extending from the forward end of the nose cone 82 and back along its sides, into a plurality of nose cone segments, to facilitate its fragmentation upon impact. In the illustrated embodiment, there are three such segments, labeled 82*a*, 82*b*, and 82*c*, but the number may be varied. It will be understood that, in alternative embodiments, the ballistic body 20 may be configured to engage the axial fingers 62 directly, thus eliminating the need for the nose cone 82.

The increased-diameter section 78 of the canister holder 14 is configured with an annular lip 88 that forms a rearward-facing shoulder 90. The shoulder 90 forms a seat for the forward end of a tubular shell casing 92 that is secured to the increased-diameter section 78 of the canister holder 14. The shell casing 92 coaxially surrounds and encloses the rearmost part of the canister holder 14 and the base 36, and it extends rearward therefrom, terminating in a casing rim portion 94. The shell casing 92 is filled with a propellant powder charge 95 that is ignited by a center-fire primer cap 96 encased in the center of the casing rim portion 94. A wadding element 98 may advantageously be provided between the powder charge 95 and the base 36. The wadding element 98 and the adjacent surface of the base 36 may advantageously have a concave configuration, as shown, to provide more room for the powder charge 95 and to enhance the propulsive force provided by its ignition.

Figure 9:
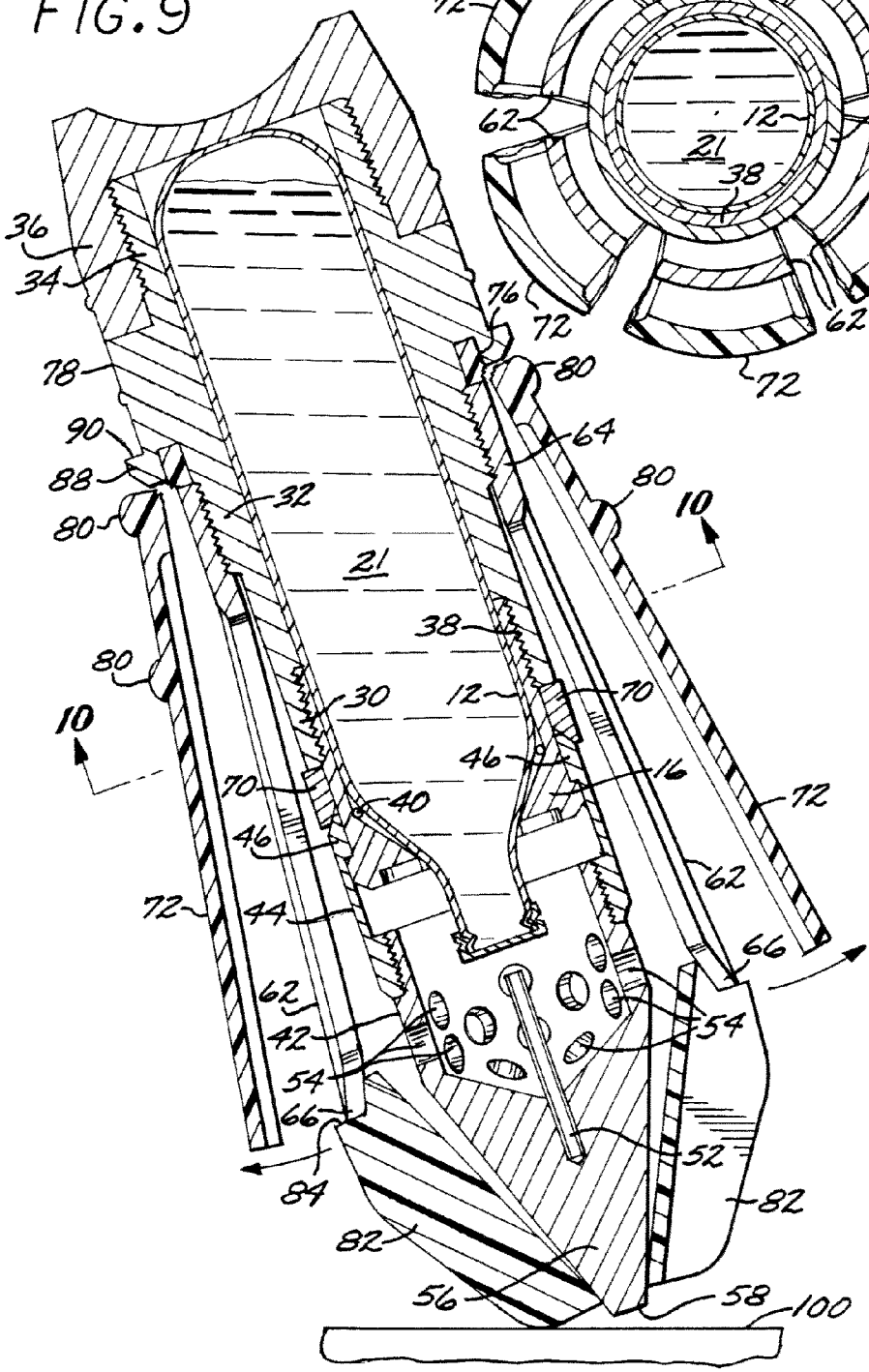
FIG. 9 is a cross-sectional view of the projectile as it first strikes a solid barrier, showing the fragmentation of the nose cone and outer sleeve and the initiation of the radial spreading of the deceleration sleeve.
Figure 10:
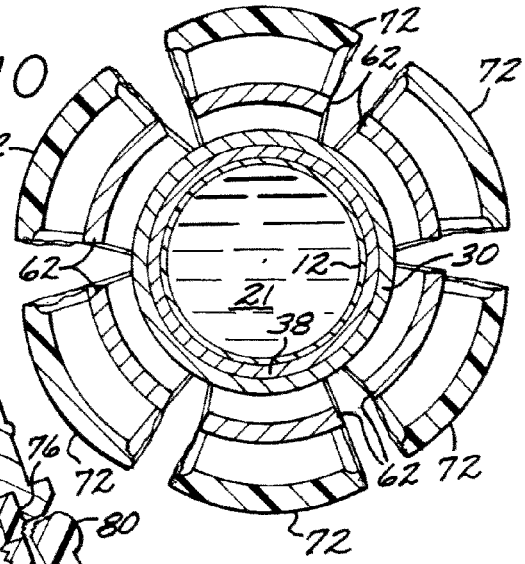
FIG. 10 is a cross-sectional view taken along line 10-10 of FIG. 9.

Referring now to FIGS. 9-14, the projectile 10, including an outer sleeve 72 of suitable diameter, is launched from a conventional grenade launcher (not shown). Upon launch, the shell casing 92 is left in the launcher, and the projectile 10 leaves the barrel (not shown) of the launcher. The projectile 10 proceeds to the targeted enclosure (i.e., a stationary structure or a vehicle). As shown in FIGS. 9 and 10, upon striking a barrier 100, such as a wall or ceiling or other solid barrier forming part of the enclosure, the nose cone 82 fragments. As it does so, its engagement with the fingers 62 causes their separation from each other along the slits 60, thereby initiating the radial spreading of the fingers 62, which, in turn, causes the outer sleeve 72 to fragment, as described above, and to separate from the rest of the projectile by breaking off at the juncture with the annular slot 76.

Figure 12:
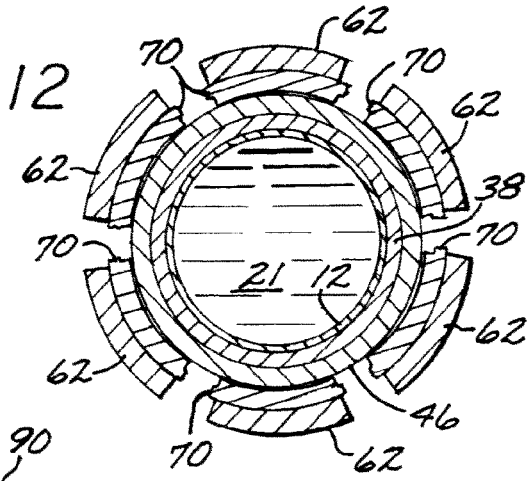
FIG. 12 is a cross-sectional view taken along line 12-12 of FIG. 11.

Then, as shown in FIGS. 11 and 12, as the penetration tip 58 of the ballistic body 20 impacts and begins to penetrate the barrier 100, the force of the impact pushes the ballistic body 20 rearward, causing the closure-breaching member 52 to breach or rupture the closure 26 of the canister 12. At the same time, the linkage element 44 is pushed rearward in the recess 48 of the canister retention collar 16, thereby urging the cam element 46 on the linkage element 44 to push against the cam follower elements 70 on the interior surfaces of the fingers 62, causing the cam follower elements 70 to move radially outward, and thereby further spreading the fingers 62 radially away from the canister retention assembly.

Figure 13:
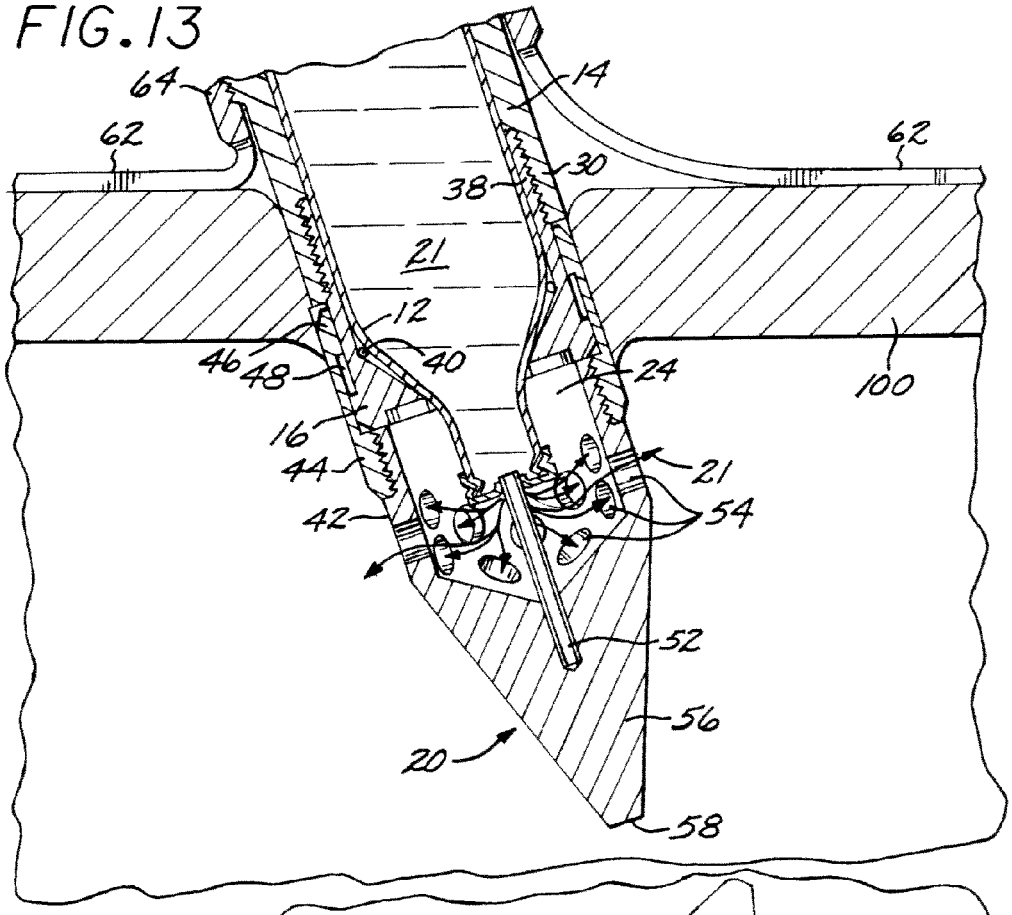
FIG. 13 is a cross-sectional view of the projectile, showing the breaching of the canister closure and the completion of the spreading of the deceleration sleeve against the barrier as the ballistic body of the projectile penetrates the barrier.
Figure 14:
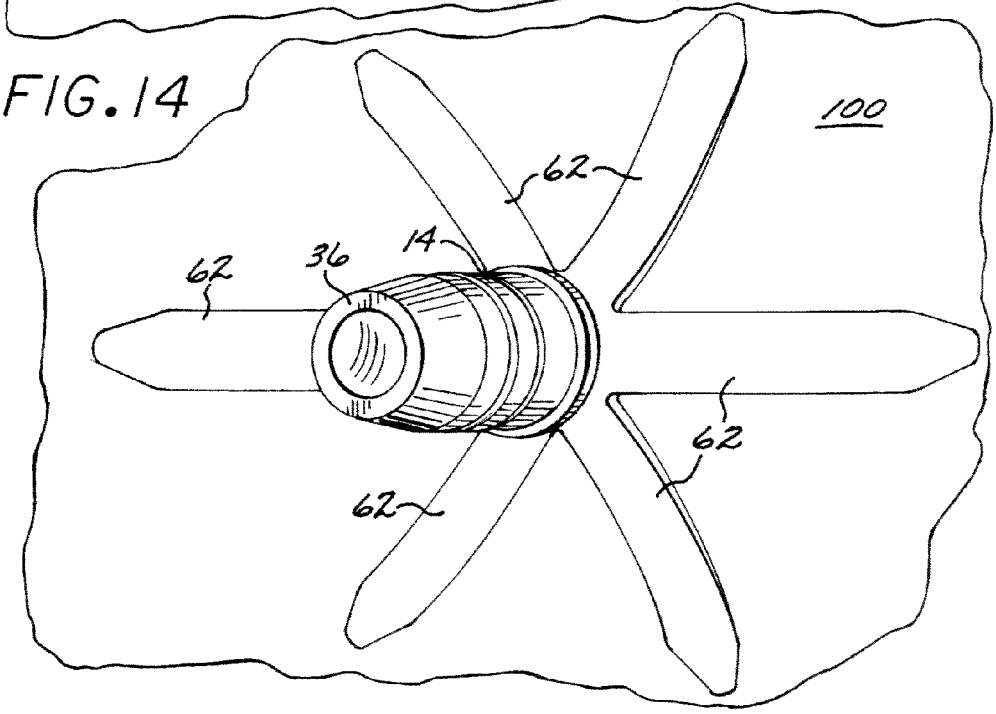
FIG. 14 is a perspective view from the back end of the projectile after the ballistic body has penetrated the barrier, showing the deceleration sleeve completely spread out radially against the exterior surface of the barrier.

Finally, as shown in FIGS. 13 and 14 the fingers 62 are fully spread radially and are peeled back from the ballistic body 20, like a banana skin, as the ballistic body 20 penetrates through the barrier 100. As the fingers 62 are peeled back axially, they expand radially outward (see FIG. 14), and they engage against the outer surface of the barrier 100 around the ballistic body, thereby preventing the projectile 10 from passing completely through the barrier 100. The projectile 10 is thus lodged in the barrier 100, with the ballistic body 20 inside the enclosure and the rearward portion of the projectile 10 coming to rest outside the enclosure, as best shown in FIG. 14. By properly configuring the conical portion 56 and the penetration tip 58 of the ballistic body 20 and/or the deformable deceleration sleeve fingers 62, the deceleration and stopping of the projectile 10 can be achieved so that enough of the ballistic body 20 passes through the barrier 100 a sufficient distance to introduce most, if not all, of the dispersion ports 54 into the interior of the enclosure. To this end, it may be advantageous to arrange the plurality of dispersion ports 54 in two or more axially-spaced rows, as shown in the drawings.

As mentioned above, and as shown in FIGS. 11 and 13, the force of the ballistic body 20 striking the barrier 100 pushes the ballistic body 20 rearward toward the retention collar 16, whereby the closure-breaching element 52 breaches the closure 26 of the canister 12, allowing the fluid contents 21 of the canister 12 to flow into the chamber 24, and then through the dispersion ports 54 and out into the ambient environment inside the enclosure on the target side of the barrier. If the canister contents 21 are liquid, the liquid is aerosolized as it flows into the chamber 24, through the ports 54, and out into the enclosure. The dispersion of the contents of the canister 12, whether as a gas or an aerosolized liquid, begins almost immediately upon the penetration of the ballistic body 20 through the barrier.

It will be appreciated from the foregoing description that the projectile 10, in accordance with the present disclosure, provides a mechanism for delivering an incapacitating agent accurately to a remote target by means of a conventional grenade launcher. Furthermore, the agent can be delivered to a target that is behind or below a sold barrier, such as a building roof or wall, or within a vehicle, and might thus be inaccessible to a conventionally-delivered gas dispersing grenade or the like. Moreover, the dispersal of the agent delivered by the projectile disclosed herein is begun almost immediately upon impact of the projectile, while the lodging of the projectile in the barrier it impacts makes it difficult to remove or dispose of by the targeted individual(s) before the agent has its desired effect.

It will be appreciated by persons of ordinary skill in the art that the embodiment described herein is exemplary only, and that a number of modifications and variations may suggest themselves to such persons. Such variations and modifications are considered within the spirit and scope of the disclosure, and the claims that follow should be construed accordingly.

What is claimed is:

1. A projectile configured for delivering an incapacitating agent to a target through a solid barrier, the projectile comprising:

a canister configured to contain an incapacitating agent and having an outlet with a breachable closure;

a canister retention assembly configured to hold the canister and including a canister holder having an external surface; a deformable, radially-expansible sleeve having a rearward end fixed to the external surface of the canister holder and configured to spread radially outward upon impact with the solid barrier, and;

a ballistic body connected to the canister retention assembly so as to be axially movable from a forward position to a rearward position upon impact with the barrier, the ballistic body including a closure-breaching member located so as to breach the closure when the ballistic body moves axially rear-ward upon impact with the barrier, the ballistic body further including a plurality of dispersion ports that are in fluid communication with the outlet of the canister when the closure is breached, wherein the ballistic body has a penetration tip configured to penetrate the solid barrier upon impact therewith.

2. The projectile of claim 1, wherein the radially-expansible sleeve has a substantially cylindrical configuration and is divided around its circumference into a plurality of radially-deformable axial fingers configured to spread radially outward against the solid barrier upon impact of the projectile with the solid barrier.

3. The projectile of claim 1, further comprising a frangible outer sleeve coaxially surrounding the radially-expansible sleeve and configured to separate therefrom upon impact of the projectile with the barrier.

4. The projectile of claim 3, wherein the canister holder includes an attachment portion to which the radially-expansible sleeve is attached, and wherein the outer sleeve is detachably attached to the canister holder proximate the attachment portion.

5. The projectile of claim 3, further comprising a frangible nose cone enclosing the ballistic body so as to be in engaging contact with the outer sleeve and with the radially-expansible sleeve, whereby, upon impact of the nose cone with the barrier, the nose cone initiates the separation of the outer sleeve and the radial expansion of the radially-expansible sleeve.

6. The projectile of claim 1, further comprising a linkage element to which the ballistic body is fixed, wherein the linkage element is movably connected to the canister retention assembly so as to be axially moveable from the forward position to the rearward position.

7. The projectile of claim 6, wherein the canister holder has a forward portion, wherein the canister retention assembly includes a canister retention collar fixed to the forward portion of the canister holder, and wherein the linkage element is movably connected to the canister retention collar.

8. The projectile of claim 6, wherein the radially-expansible sleeve has a substantially cylindrical configuration and is divided around its circumference into a plurality of radially-deformable axial fingers configured to spread radially outward against the solid barrier upon impact of the projectile with the solid barrier, each of the fingers having an interior surface with a cam follower element thereon, and wherein the linkage element has a cam element located thereon so as to engage the cam follower element of each of the fingers, the cam element being configured to urge the fingers radially outward as the linkage element moves from the forward position to the rearward position.

9. A projectile configured for delivering an incapacitating agent to a target through a solid barrier, the projectile comprising:

a canister filled with an incapacitating agent and having an outlet with a breachable closure;

a canister retention assembly configured to hold the canister and having an external surface;

a plurality of radially-deformable axial fingers, each having a rearward portion attached to the external surface of the canister retention assembly, the fingers being configured to spread radially outward upon impact with a solid barrier;

a ballistic body having a dispersion port, the ballistic body being movably connected to the canister retention assembly forward of the canister so as to be axially movable from a forward position to a rearward position upon impact with the barrier; and a closure-breaching member mounted in the ballistic body and located with respect to the canister so as to breach the closure when the ballistic body is moved to its rearward position, thereby opening a fluid path from the canister through the ballistic body and the dispersion port;

wherein the ballistic body is configured to penetrate the barrier upon impact therewith, and wherein the movement of the ballistic body to its rearward position forces the axial fingers to spread radially outward against the barrier upon impact therewith, thereby lodging the ballistic body in the barrier in position for the dispersal of the incapacitating agent through the dispersion port on the side of the barrier opposite the fingers.

10. The projectile of claim 9, further comprising a frangible outer sleeve coaxially surrounding the axial fingers and configured to separate therefrom upon impact of the projectile with the barrier.

11. The projectile of claim 10, wherein the canister retention assembly includes an attachment portion to which the axial fingers are attached, and wherein the outer sleeve is detachably attached to the canister retention assembly proximate the attachment portion.

12. The projectile of claim 11, further comprising a frangible nose cone enclosing the ballistic body so as to be in engaging contact with the outer sleeve and with the axial fingers, whereby, upon impact of the nose cone with the barrier, the nose cone initiates the separation of the outer sleeve and the radial expansion of the axial fingers.

13. The projectile of claim 9, further comprising a linkage element to which the ballistic body is fixed, wherein the linkage element is movably connected to the canister retention assembly so as to be axially moveable from the forward position to the rearward position.

14. The projectile of claim 13, wherein the canister retention assembly includes a canister holder having a forward portion, and a canister retention collar fixed to the forward portion of the canister holder, wherein the canister holder includes the external surface to which the axial fingers are attached, and wherein the linkage element is movably connected to the canister retention collar.

15. The projectile of claim 13, wherein each of the axial fingers has an interior surface with a cam follower element thereon, and wherein the linkage element has a cam element located thereon so as to engage the cam follower element of each of the axial fingers, the cam element being configured to urge the axial fingers radially outward as the linkage element moves from the forward position to the rearward position.

16. A method of delivering an incapacitating agent to a target through a solid barrier, comprising:

(a) providing a projectile comprising:

a canister containing an incapacitating agent and having a breachable closure;

a canister holder configured to hold the canister and having an exterior surface;

a radially-expansible sleeve attached to the exterior surface of the canister holder;

a ballistic body configured to penetrate the barrier and having a dispersion port;

the ballistic body being movably connected to the canister holder so as to be axially movable between a forward position and a rearward position upon impact with the barrier; and a closure-breaching member fixed to the ballistic body so as to breach the closure and establish fluid communication between the canister and the dispersion port when the ballistic body moves to its rearward position;

(b) launching the projectile toward a target behind or beneath the barrier;

(c) impacting and penetrating the barrier with the ballistic body, thereby moving the ballistic body from its forward position to its rearward position, and thereby causing the closure-breaching member to breach the closure so as to establish a fluid path from the canister through the dispersion port; and (d) radially spreading the radially-expansible sleeve against the barrier so as to lodge the projectile in the barrier with the dispersion port on the target side of the barrier.

17. The method of claim 16, wherein the radially-expansible sleeve has a substantially cylindrical configuration and is divided around its circumference into a plurality of radially-deformable axial fingers, and wherein the step of radially spreading the expansible sleeve comprises spreading the fingers radially outward against the solid barrier upon impact of the projectile with the solid barrier.

18. The method of claim 16, wherein the ballistic body has a forward portion terminating in a penetration tip configured to penetrate the solid barrier upon impact therewith.

19. The method of claim 16, wherein the projectile further comprises a frangible outer sleeve coaxially surrounding the radially-expansible sleeve, and wherein the step of impacting and penetrating the barrier includes the steps of:

(c)(1) fragmenting the outer sleeve and separating it from the projectile upon impact with the barrier; and (c)(2) penetrating the barrier with the ballistic body.

20. The method of claim 19, wherein the canister holder includes an attachment portion to which the radially-expansible sleeve is attached, and wherein the outer sleeve is detachably attached to the canister holder proximate the attachment portion.

21. The method of claim 16, wherein the projectile further comprises a frangible outer sleeve coaxially surrounding the radially-expansible sleeve, and a frangible nose cone enclosing the ballistic body so as to be in engaging contact with the outer sleeve and with the radially-expansible sleeve, and wherein the step of impacting and penetrating the barrier comprises the steps of (c)(1) impacting the barrier with the nose cone and thereby fragmenting the nose cone;

(c)(2) with the fragmentation of the nose cone, initiating the separation of the outer sleeve and the radial expansion of the radially-expansible sleeve through the engagement of the nose cone with outer sleeve and the radially-expansible sleeve; and (c)(3) penetrating the barrier with the ballistic body.

22. The method of claim 16, wherein the projectile further comprises a linkage element to which the ballistic body is fixed, wherein the linkage element is movably connected to the canister holder so as to be axially moveable from the forward position to the rearward position.

23. The method of claim 22, wherein the canister holder has a forward portion to which a canister retention collar is fixed, and wherein the linkage element is movably connected to the canister retention collar.

24. The method of claim 23, wherein the radially-expansible sleeve has a substantially cylindrical configuration and is divided around its circumference into a plurality of radially-deformable axial fingers configured to spread radially outward against the solid barrier upon impact of the projectile with the solid barrier, each of the fingers having an interior surface with a cam follower element thereon, and wherein the linkage element has a cam element located thereon so as to engage the cam follower element of each of the fingers, the cam element being configured to urge the fingers radially outward as the linkage element moves from the forward position to the rearward position.

* * * * *